US005996602A

United States Patent [19]

Cato, III

[11] Patent Number: 5,996,602

[45] **Date of Patent: *Dec. 7, 1999**

[54] HIKING POLE

[75] Inventor: Wayland H. Cato, III, Cedar Island, N.C.

[73] Assignee: Mobility Devices, Inc., Wilmington, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/900,937

[22] Filed: Jul. 28, 1997

Related U.S. Application Data

[60] Provisional application No. 60/022,387, Jul. 29, 1996.

[51] Int. Cl.[6] ..... A45B 5/00

[52] U.S. Cl. ..... 135/75; 135/65; 135/76

[58] Field of Search ..... 135/65, 75, 76, 135/77, 78; 280/819, 821, 823

[56] References Cited

U.S. PATENT DOCUMENTS

| | | | |
|---|---|---|---|
| 2,408,604 | 10/1946 | Brickson | 135/75 X |
| 4,121,605 | 10/1978 | Schmerl | 135/65 |
| 4,252,137 | 2/1981 | Cohen | 135/75 X |
| 4,616,668 | 10/1986 | Battiston | 135/75 |
| 5,495,867 | 3/1996 | Block | 135/65 |
| 5,778,914 | 7/1998 | Trani | 135/66 |

*Primary Examiner*—Carl D. Friedman
*Assistant Examiner*—Kevin D. Wilkens
*Attorney, Agent, or Firm*—Rhodes & Mason, PLLC

[57] ABSTRACT

A hiking pole comprised with a telescoping staff, a handgrip extending outwardly from the rear of the staff when the staff is in an upright position, the handgrip including an elongated hand engaging section having an outer end and an inner end, the handgrip having a longitudinal axis at an angle of from about 10° to about 45° to the longitudinal axis of the staff, the handgrip inner end being attached to the staff at a position whereby a user's hand is raised to at least the level of the user's chest to grasp the handgrip; and a balance section projecting toward the front of the staff, the balance section having a longitudinal axis at an angle of from about 10° to about 45° relative to the staff longitudinal axis.

15 Claims, 2 Drawing Sheets

HIKING POLE

Priority of provisional application Ser. No. 60/022,387, filed Jul. 29, 1996 is claimed.

BACKGROUND OF THE INVENTION (1) Field of the Invention

The present invention relates generally to a hiking stick or pole, and in particular to a hiking pole that is configured to reduce strain on the user's wrist and arm, while providing greater balance, support and thrust.

(2) Description of the Prior Art

Hiking poles, also known as walking sticks or staffs, have remained essentially unchanged for millennia. Basically, the pole is simply a straight staff with an upper end that is gripped by the hiker and a lower end that engages the ground or other surface. The hiker simply places the lower end of the pole against the ground, normally alongside or slightly ahead of his body and, as he walks forward, pushes downward and backward to gain support and forward thrust. Changes made in the construction of the hiking pole, until now, have been directed to ways to improve the hiker's grip on the upper end of the pole.

When used for a short period of time, or over gentle terrain, the hiking pole is perfectly satisfactory in its present form, perhaps accounting for the lack of changes in its design. However, when strenuous hikes are undertaken, especially over a long period or over difficult terrain, the design of the pole can cause strain on the user's arm and wrist. Also, the balance, stability and thrust provided by the conventional hiking pole is less than optimum.

It is an object of the present invention to provide an improved design for a hiking pole that overcomes these deficiencies. It is also an object of the invention to provide an improved hiking pole that can be adjusted to meet the needs of users of different heights.

Other objectives of the invention will become apparent to one skilled in the art upon reading the description of the invention that follows.

SUMMARY OF THE INVENTION

The hiking pole of the present invention is comprised of a staff, a handgrip attached to the upper end of the staff, and a balance section on the opposite side of the staff from the handgrip. The handgrip and balance section are attached to the staff at defined angles. The handgrip and balance sections may also include coverings for improved grip and comfort. A detachable cap or tip at the lower end of the staff is provided for protection of the staff and improved surface contact.

In the basic embodiment, the staff is a straight tube or rod, preferably of a round or oval cross-section, having a lower end to engage the ground, and an upper end. The staff is of a length such that a handgrip mounted on the staff will be approximately chest to shoulder high to the user when the pole is held in an upright position with the staff being vertical. The upper end of the staff is adapted to be secured to the hand grip to be described hereinafter in greater detail.

While the staff may be on one piece, in a more sophisticated embodiment the staff is adjustable in length, and is formed of an upper staff section, and a lower staff section, adapted to slide within the upper staff section. A locking mechanism is provided to secure the sections at a desired length. In both embodiments, the lower end of the staff can be capped with a replaceable tip to protect the staff and provide a more secure engagement with the surface. The tip can be of various shapes depending upon the type of terrain to be crossed. For example, the tip can be pointed to penetrate the surface, or in the form of a disk to prevent sinking of the staff into soft surfaces.

The handgrip section is comprised of an elongated center section to be gripped by the user, and a lower end adapted to be attached to the upper end of the staff. The center section may be configured along its upper surface with finger receiving recesses, and may be wrapped with a covering to provide an improved grip and comfort. A loop of material can also be provided to help in holding the user's hand in contact with the handgrip. The lower end of the handgrip may include threaded recesses to receive the end of the staff, or a recess may be of a dimension to hold the end of the staff by friction, especially when the handgrip is made of a resilient material.

The handgrip is designed to be positioned at a predetermined angle relative to the staff. Specifically, when the handgrip is joined to the staff, and the staff is held in a vertical position, the handgrip will preferably extend toward the user at an angle of at least 5° to as great as 45°, and preferably from about 20° to about 40°, in relation to the longitudinal axis of the staff. The length of the staff is such that the handgrip is positioned at a level with the user's chest or higher, e.g., a horizontal level from about chest or shoulder height to about the height of the top if the user's head, i.e., the distance from the tip to the handgrip is usually about 3.5 to 6.5 feet, more often about 4.0 to about 5.5 feet, depending upon the height of the user.

The hiking pole preferably also includes a balance section, which can also serve as an additional handgrip and/or as a storage container. The balance section may be comprised of a tube or rod having a lower end adapted to be secured to the staff or to the handgrip. In the more sophisticated embodiment, the balance section is weighted at the upper end to improve balance. The interior of the balance section can also include an interior storage compartment or hollow area for storage of water or emergency items, in which case the stored goods can serve as the weight. The balance section can also be telescoping, e.g., formed of an upper staff section, a lower staff section adapted to slide within the upper staff section, and a locking mechanism to secure the sections at a desired length.

The balance section is positioned at an angle of from about 5° to about 90°, and preferably from about 20° to about 40°, in relation to the axis of the staff, and lies in a plane with the staff and the handgrip. While the description of the balance section is in terms of a straight tube or rod, it will be understood that the balance section can be curved, in which case the axis of the balance section will be along a line between the ends of the balance section.

The balance section may be longitudinally adjustable, so that the weight of the balance section will approximately counterbalance the weight to the staff, reducing the tendency of the pole to rotate about the handgrip where held by the user, thereby reducing the strain on the user's wrist. Thus, the hiker or user is able, particularly with the angular positioning of the handgrip, to enjoy greater comfort over an extended period of use.

The basic hiking pole segments, i.e., the staff, handgrip, and balance section, may be assembled in different ways while still achieving the objectives of the present invention. In one alternative, the handgrip can be positioned at the top of the staff, with the balance section being attached to the top of the handgrip. In this alternative, the handgrip is inclined backward toward the user, while the balance section extends forward, with the staff, handgrip and balance section all lying in a plane. The balance section is preferably of a length sufficient to intersect the longitudinal axis of the staff.

In another embodiment, the rearwardly inclined handgrip can have an inner end attached to the staff below the top of the staff, while the balance section is attached to the staff above the handgrip and inclined forward.

In a particularly preferred embodiment, the hiking pole of the present invention is comprised of a generally vertical staff, a rearwardly inclined handgrip positioned adjacent the top of the staff, and a forward inclined balance section attached to the staff below the handgrip. As in the other alternatives, the staff, handgrip and balance section lie in a common plane. The length of the staff is such that the handgrip is positioned at approximately chest or shoulder height.

When used, the hiker reaches to a level of about chest or shoulder height to grasp the handgrip, and the tip of the pole is moved forward. The hiker then walks forward past the tip of the pole, while pulling down on the handgrip, lifting the hiker's body weight upward and forward. Positioning of the handgrip at the level of the user's chest or shoulder avoids bending of the user's wrist, and resultant discomfort.

Looking at the construction of the preferred embodiment in more detail, the staff, while it may be of one piece, is desirably of a telescoping construction, so that its length can be adjusted to accommodate users of different heights. The length of the staff can thus be adjusted to correctly position the handgrip at a level with the user's chest or shoulder. For example, the staff can be formed of a first tubular section of a given outer diameter, e.g., 1–1.5 inches, and a second tubular section with an outer diameter equal to, or slightly less than, the inner diameter of the first section, slidably positioned inside the first section.

A locking means is used to hold the inner section at the desired extension. A locking means that is commonly used to lock telescoping tubular sections, is comprised of a plurality of axially spaced holes in the outer tubular section, and a spring loaded locking button extending outwardly from the inner tubular section, preferably from near the upper end of the section, so that it can project into a selected hole positioned over the button. The tubular sections are preferably formed of a metal, such as aluminum, although other materials, e.g., plastic, carbon fiber, or titanium, can be used. Other locking means, such as frictional locks of the kind known in the relevant art, can also be used for this purpose.

The handgrip is positioned as an angle, so that it can be gripped without twisting of the wrist and placing the muscles of the forearm under stress. For this reason, the handgrip will normally be inclined backward from its attached end to its distal end, that is, the longitudinal axis of the handgrip will be at an angle of about 20–40°, preferably about 30° from the longitudinal axis of the staff.

The handgrip is generally of a length and diameter sized to accommodate the user's hand. For example, the handgrip may be a metal tube having a length of from about 3 to about 6 inches, and a diameter of from about 0.75 to about 1.5 inches. A resilient covering may be positioned over the tube to improve comfort and grip. The grip may be further improved by forming finger recesses in the covering. Alternatively, the handgrip may be formed of molded plastic or rubber, in which case the molded handgrip can have finger grips molded into its construction.

The handgrip may be formed as a separate part of the pole, or may be formed by bending the top end of the staff in a rearward direction at the desired angle. Thus, while the handgrip and staff are described as separate elements for purposes of describing the pole, it is to be appreciated that these elements can be integrally formed from a single piece of tubing by bending the tubing to the desired shape.

The balance section, which may be formed of the same material as the staff sections, will be angled upwardly and forward on opposite sides of the staff from the handgrip. In one embodiment, the balance section has an inner end joined to the staff, and an outer end. The outer end may be capped with an end cap to prevent debris from entering the tube, and for aesthetic purposes. A pad or covering, e.g., a tubular foam covering, may be placed over the section to improve comfort when used as a handgrip.

The inner end of the balance section may be connected to the staff by welding, or by the use of a fastening means, such as a threaded bolt. Alternatively, the balance section may be integrally molded with the section of the staff where it is joined. For example, the staff section adjacent the balance section can be integrally formed with the balance section, and optionally the handgrip, with the remainder of the staff being attached to the lower part of this section, e.g., by a threaded or frictional connection.

The balance section may also be detachable from the staff. In this alternative, the inner end of a balance section fitting is secured to the staff, e.g., by welding. The outer end is adapted to be connected, by a screw fitting, friction fitting, or otherwise, to the inner end of the balance section, so that the balance section projects upwardly at the desired angle. Preferably the balance section fitting is comprised of a generally horizontal inner segment and an upwardly angled outer segment, with the inner segment having an inner end attached to the staff and an outer end attached to the inner end of the outer segment. The outer end of the outer segment is attached to the inner end of the balance section.

The balance section serves primarily to balance the weight of the pole, so that the pole will hang generally vertically from the handgrip, and will not tend to pivot. However, the balance section can also serve as a handgrip and/or as a storage compartment for various items, particularly items for use in an emergency. Normally, the user will grip the primary handgrip during walking or hiking. However, when moving upwardly along an inclined area, such as when climbing a hill, the primary handgrip may be too high for comfortable use. If so, the user simply rotates the staff, so that the primary handgrip is to the front of the staff, and the balance section is to the rear. The user then grips the balance section, using it as a handgrip. Similarly, in embodiments where the balance section is above the handgrip, the pole can be rotated and the balance section used as a handgrip when going downhill.

The handgrip can also be hollow so that items, such as first aid items, emergency food, compass, fishing gear, signal devices, and the like, can be stored in the interior of the balance section. In the event of an injury, the hiker can also use the pole as an emergency crutch by placing the balance section or the handgrip under the arm.

The handgrip of the pole is positioned at a level approximately equal to the user's chest or shoulder when the pole is in an upright position. At this level, and with the angle of the handgrip, the handgrip can be grasped without bending of the wrist, which permits maximum pull on the pole without discomfort or damage to the user.

It will be understood that the various components of the present invention may be made of different materials, depending upon the desired use and economic requirements.

For example, the staff and balance sections can be made of fiberglass or aluminum, or a more expensive material such as titanium or graphite. The handgrip, or the combination of the handgrip and balance section can be made of a single molded material such as rubber or a plastic, such as nylon or polyester, or can be of a composite construction, with a molded core and a resilient covering. The tip can be made of a molded rubber or plastic, or can be of a metal, e.g., stainless steel. The loop can be plastic or fabric, e.g., woven nylon.

A single pole can be used, or a pair of poles can be used, depending on the desires of the hiker, and the terrain to be covered. Also, the poles are suitable for use by hikers over hilly, uneven terrain, or relatively level terrain, such as a sandy beach, and can also be used by snow skiers in the same manner as conventional ski poles.

Accordingly, one aspect of the present invention is to provide a hiking pole comprised of a generally vertical, extendible staff; a handgrip at the upper end of the staff angled toward the rear of the staff; and an balance section angled toward the front of the staff.

Another aspect of the present invention is to provide a hiking pole comprised of an extendible, locking staff having an upper end and a lower end; a handgrip positioned at the top of the staff and angled toward the rear of the staff at an angle of about 20° to about 45° from the staff axis; and a balance section extending upwardly from the front of the staff, the balance section being attached to the staff at a level below the level of the handgrip when the pole is in an upright position.

It is yet another aspect of the invention to provide a pole comprised of a molded handgrip member having a lower staff receiving recess and an upper balance section receiving recess; an extendible staff having an upper end insertable into the staff receiving recess; and a balance section having a lower end insertable into the balance section receiving recess.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. In particular, it should be apparent that the description of the pole as having a generally vertical staff, a rearwardly inclined handgrip, and a forward inclined balance section, is for the purpose of describing the relative positions between the staff, handgrip and balance section, and is not to limit the invention to a pole in this particular position. Also, the drawings are for the purpose of illustrating the invention and are not intended to be to scale.

Figure 1:
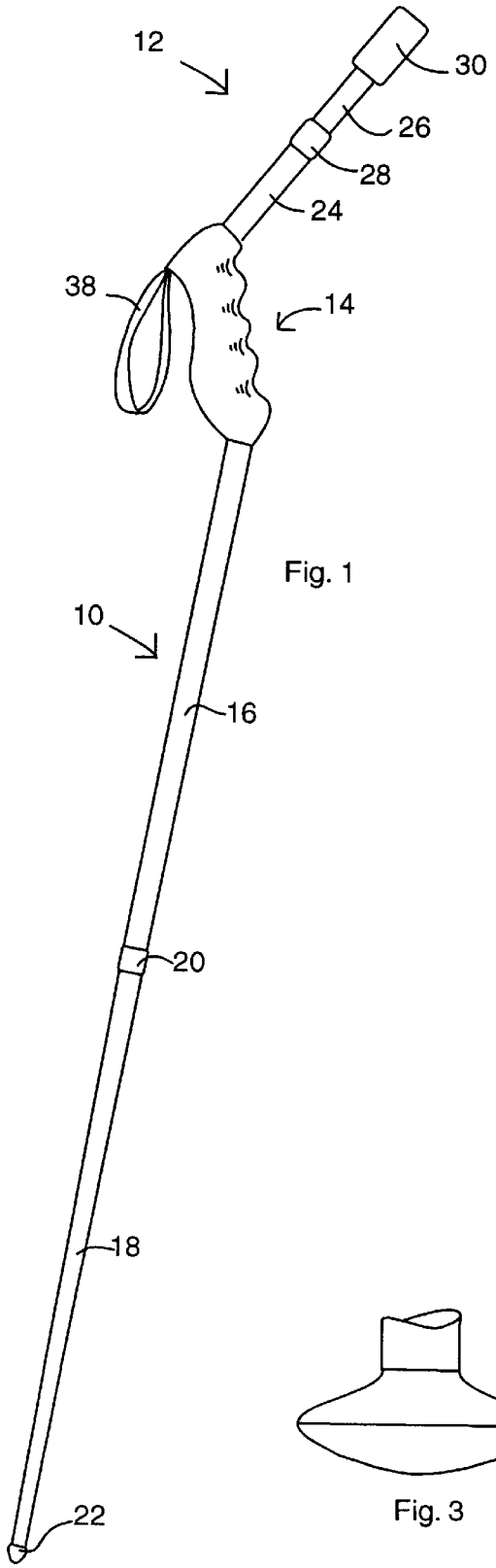
FIG. 1 is a side view of the pole of the present invention.
Figure 3:
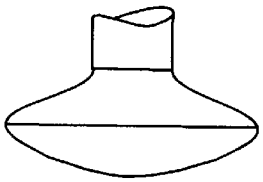
FIGS. 3–5 are illustrations of various tip designs. The tip of FIG. 3 is designed for soft surfaces, e.g., sand.
Figure 4:
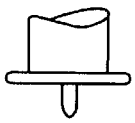
Figure 5:
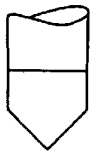

As best shown in FIG. 1, one embodiment of the hiking pole is comprised of a staff 10, an upper balance section 12, and a handgrip section 14. Staff 10 is comprised of an upper staff section 16, a lower staff section 18, adapted to slide within section 10. Locking mechanism 20, which is of conventional design, being rotated about the staff to lock or unlock the sections, secures section 18 at the desired extension. The lower end of staff 18 is capped with tip 22 to protect the staff and provide a more secure engagement with the surface. Tips can be of various shapes including the shapes illustrated in FIGS. 3–5, or can be of the type used on ski poles.

Balance section 12 is comprised of a lower staff section 24, an upper staff section 26, adapted to slide within section 24, and a locking mechanism 28 to secure the sections at a desired length. A weight 30 is positioned at the outer end of section 26. It will be understood that this weight can be located in the interior of section 26, instead of on the exterior, as illustrated. Weight 30 may be longitudinally positioned along the axis of section 12.

Figure 2:
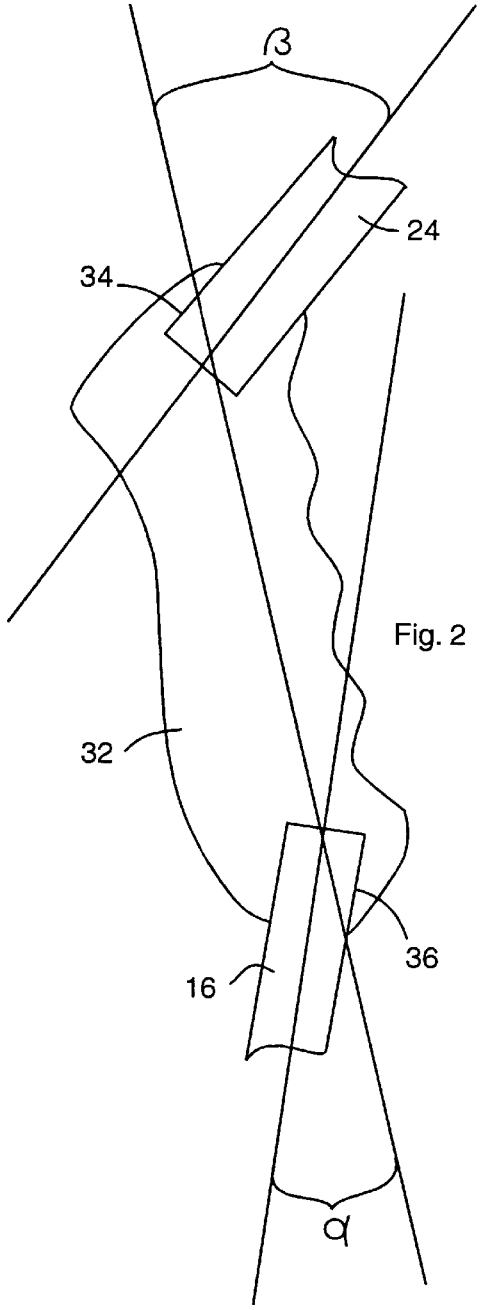
FIG. 2 is a detailed cross section of the handgrip section of the invention, showing the angular relationship of the staff and balance sections.

Handgrip 14, best illustrated in FIG. 2, is comprised of an elongated center section 32 with an upper recess 34 adapted to receive the lower staff 24 of balance section 12, and a lower recess 36 to receive the upper end of upper staff section 16. A nylon loop 38 is attached near the upper end of handgrip 32.

Staff 10 and balance section 12 are positioned at the predetermined angles in relation to handgrip 12. Specifically, the longitudinal axis of staff 10 is at angle $\alpha$ of from about 10° to about 45°, preferably about 20° to 40°, e.g., 30°, in relation to the axis of handgrip center section 32. Balance section 12 is positioned at an angle $\beta$ of from about 20° to about 60° in relation to the axis to the handgrip center section 32, and lies in a plane with staff 10. The end of balance section 12 extends toward, and preferably at least to the longitudinal axis of staff 10.

When the above described pole is to be used, the length of staff 10 is adjusted so that the weight of balance section 12 approximately counterbalances the weight of staff 10, reducing the strain on the users wrist, and with the angular positioning of the handgrip, proving greater comfort over an extended period of use. It has also been observed that the presence of the weighted section gives the feeling that the pole is being pulled forward when the top of the pole is tilted in the forward direction.

Figure 6:
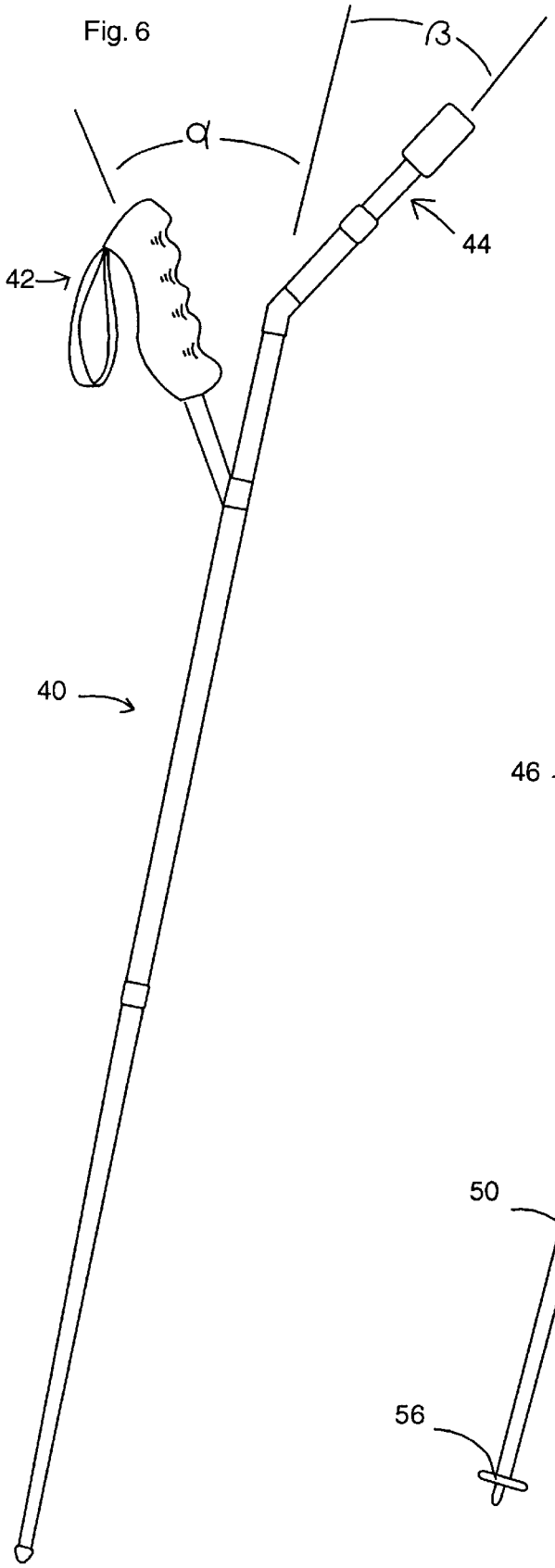
FIG. 6 illustrates an alternative way to attach the handgrip to the pole.

An alternative construction is illustrated in FIG. 6, with handgrip 42 being attached to the side of staff 40 at an angle $\alpha$ equal to from about 20° to about 45°, and the balance section 44 extending from the top of staff 40 at an angle $\beta$ equal to from about 20° to about 45°, and preferably equal to angle $\alpha$.

Figure 7:
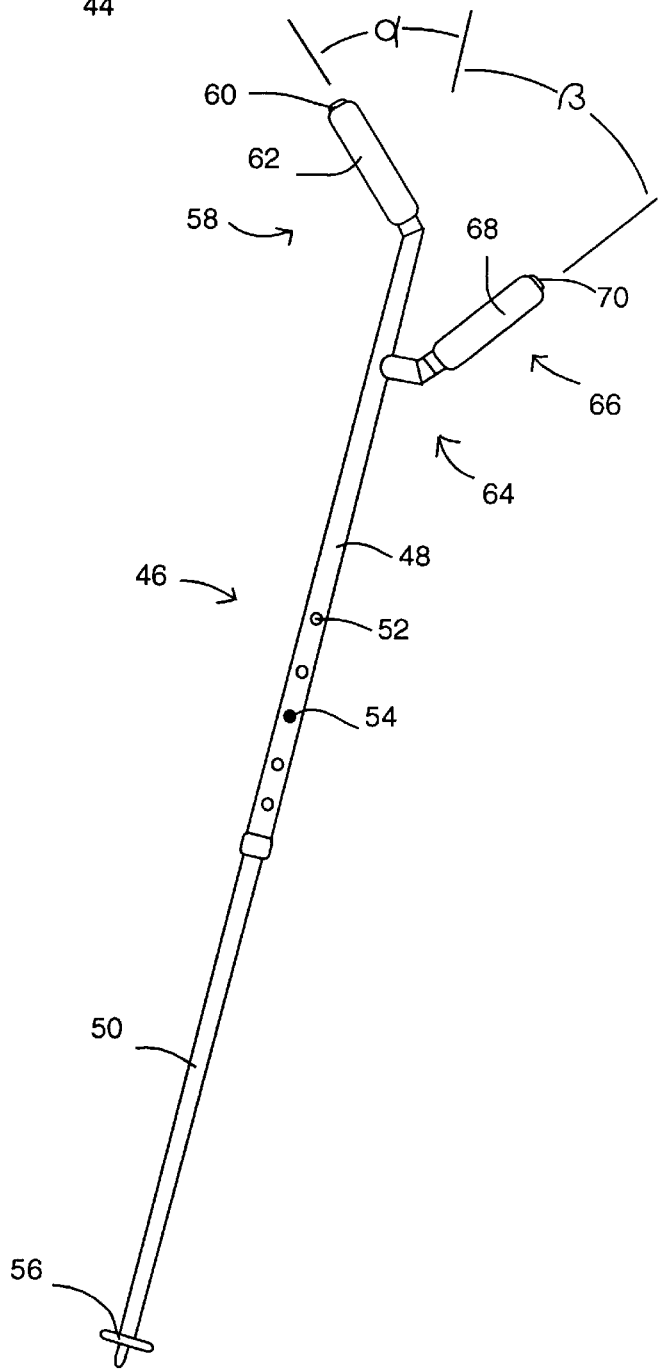
FIG. 7 illustrates an alternative embodiment of the invention, in which the balance section is attached to the staff below the handgrip.

FIG. 7 illustrates an embodiment of the invention formed from welded segments. In this embodiment, the pole is comprised of a telescoping support staff, generally 46, formed of a tubular outer section 48 and a tubular inner section 50, slidably positioned inside section 48. Section 48 includes a plurality of evenly spaced, axially aligned holes 52 positioned to receive a spring loaded locking button 54 attached to the upper end of staff section 50, to lock the sections in the desired relationship. A tip 56 of the type similar to that used on conventional ski poles is fitted over the lower end of section 50.

Handgrip 58, projects rearwardly and upwardly from its attached inner end to its outer end at an angle $\alpha$ of 30° from the axis of staff 46. Handgrip 58 can be fitted with a cap 60 at its distal end and a foam rubber tubular cover 62.

The pole shown in FIG. 7 also includes a balance section fitting 64 adapted to secure a balance section 66 to staff 46. The outer end of fitting 64 is angled upwardly, so that balance section 66 projects upwardly at angle β which, in the illustrated embodiment is 30°, the same as angle β. Balance section 66 is also covered with a cover 68 to improved grip and comfort, and has an end cap 70.

Balances section 66 of the pole illustrated in FIG. 7 can be detached, e.g., unscrewed, from fitting 64, and another type of balance section can be used. For example, balance section 12 of FIG. 1 can be used with the pole construction of FIG. 7.

Certain modifications and improvements will occur to those skilled in the art upon a reading of the foregoing description. By way of example, the balance section of the pole can be used without the angular handle, or the staff and handgrip can be used together, without the balance section. Also, the lower end of the staff can be angled toward the front of the pole to provide improved contact under some conditions. The staff and the balance section, while shown as being of two telescoping sections, can be of three or more sections. It should be understood that all such modifications and improvements have been deleted herein for the sake of conciseness and readability but are properly within the scope of the invention.

What is claimed is:

1. A hiking pole comprised of:

a) a telescoping staff having a longitudinal axis, an upper end and a lower end;

b) an upwardly extending handgrip having a longitudinal axis, an upper end and an inner end attached to the upper end of said staff, the longitudinal axis of said handgrip being at an angle of from about 10° to about 45° in relation to the longitudinal axis of said staff, whereby said staff can be telescoped to position said handgrip at a horizontal level with the hiker's chest or shoulder when said staff is held in a vertical position and the lower end of said staff is on the ground; and c) a balance section having a longitudinal axis and a lower end attached to the upper end of said handgrip, said handgrip and said balance section being in a plane with said staff, said handgrip extending outwardly from one side of said staff, and said balance section extending in the direction of the opposite side of said staff, the longitudinal axis of said balance section being at an angle of from about 10° to about 45° in relation to the longitudinal axis of said staff.

2. The pole of claim 1, wherein the angle between the longitudinal axis of said handgrip and the longitudinal axis of the staff is from about 20° to about 40°.

3. The hiking pole of claim 1, wherein said handgrip has an upper surface with finger recesses.

4. The hiking pole of claim 1, wherein said handgrip further includes a balance section fitting at the upper end of said handgrip for detachably securing said balance section.

5. The hiking pole of claim 1, wherein said balance section is longitudinally extendible.

6. The hiking pole of claim 1, wherein said telescoping shaft includes locking tubular sections.

7. The hiking pole of claim 1, further including a detachable tip at the lower end of said staff.

8. A hiking pole comprised of:

a) a telescoping staff having a longitudinal axis, an upper end and a lower end;

b) an upwardly extending handgrip having a longitudinal axis, an upper end and an inner end attached adjacent to the upper end of said staff, the longitudinal axis of said handgrip being at an angle of from about 10° to about 45° in relation to the longitudinal axis of said staff, whereby said staff can be telescoped to position said handgrip at a horizontal level with the hiker's chest or shoulder when said staff is held in a vertical position and the lower end of said staff is on the ground; and c) a balance section having a longitudinal axis and a lower end attached to the upper end of said staff, said handgrip and said balance section being in a plane with said staff, said handgrip extending outwardly from one side of said staff, and said balance section extending outwardly from the opposite side of said staff, the longitudinal axis of said balance section being at an angle of from about 10° to about 45° in relation to the longitudinal axis of said staff.

9. The pole of claim 8, wherein the angle between the longitudinal axis of said handgrip and the longitudinal axis of the staff is from about 20° to about 40°.

10. The hiking pole of claim 8, wherein said handgrip has an upper surface with finger recesses.

11. The hiking pole of claim 8, further including a balance section fitting at the upper end of said handgrip for detachably securing said balance section.

12. The hiking pole of claim 8, wherein said balance section is longitudinally extendible.

13. The hiking pole of claim 8, wherein said telescoping shaft includes locking tubular sections.

14. The hiking pole of claim 8, further including a detachable tip at the lower end of said staff.

15. A hiking pole comprised of:

a) a telescoping staff having a longitudinal axis, an upper end and a lower end;

b) an upwardly extending handgrip having a longitudinal axis, an upper end and an inner end attached to the upper end of said staff, the longitudinal axis of said handgrip being at an angle of from about 10° to about 45° in relation to the longitudinal axis of said staff, whereby said staff can be telescoped to position said handgrip at a horizontal level with the hiker's chest or shoulder when said staff is held in a vertical position and the lower end of said staff is on the ground;

c) a balance section having a longitudinal axis and a lower end attached to the upper end of said handgrip, said handgrip and said balance section being in a plane with said staff, said handgrip extending outwardly from one side of said staff, and said balance section extending in the direction of the opposite side of said staff; and d) a balance section fitting at the upper end of said handgrip for detachably securing said balance section.

* * * * *